US008779293B2

(12) United States Patent
Cho et al.

(10) Patent No.: US 8,779,293 B2
(45) Date of Patent: Jul. 15, 2014

(54) COAXIAL CABLE

(75) Inventors: Bong-Kwon Cho, Susanjin-gu (KR); Sang-Sik Shin, Dalseo-gu (KR)

(73) Assignee: LS Cable & System Ltd., Anyang-si, Gyeonggi-do (KR)

( * ) Notice: Subject to any disclaimer, the term of this patent is extended or adjusted under 35 U.S.C. 154(b) by 658 days.

(21) Appl. No.: 12/574,978

(22) Filed: Oct. 7, 2009

(65) Prior Publication Data

US 2010/0212926 A1 Aug. 26, 2010

(30) Foreign Application Priority Data

Feb. 24, 2009 (KR) ..... 10-2009-0015331

(51) Int. Cl.
*H01B 11/18* (2006.01)

(52) U.S. Cl.
USPC ..... 174/102 D

(58) Field of Classification Search
USPC ..... 174/102 D, 110 F
See application file for complete search history.

(56) References Cited

U.S. PATENT DOCUMENTS

| | | | | |
|---|---|---|---|---|
| 3,173,990 | A * | 3/1965 | Lamons | 174/102 R |
| 3,582,536 | A * | 6/1971 | Miller | 174/102 D |
| 3,777,045 | A * | 12/1973 | Artbauer | 174/28 |
| RE30,194 | E * | 1/1980 | Bruno et al. | 174/28 |
| 4,368,350 | A * | 1/1983 | Perelman | 174/102 D |
| 5,760,334 | A * | 6/1998 | Ziemek | 174/28 |
| 6,459,836 | B1 * | 10/2002 | Bocanegra et al. | 385/107 |
| 7,044,785 | B2 * | 5/2006 | Harwath et al. | 439/585 |
| 2008/0242754 | A1 * | 10/2008 | Champagne et al. | 521/94 |

FOREIGN PATENT DOCUMENTS

DE 3208297 * 9/1983

* cited by examiner

*Primary Examiner* — Chau N Nguyen
(74) *Attorney, Agent, or Firm* — Sherr & Jiang, PLLC

(57) ABSTRACT

A coaxial cable including: an inner conductor located at the center portion of the cable; an insulator surrounding the outside of the inner conductor; an outer conductor surrounding the outside of the insulator; and a sheath surrounding the outer conductor, wherein the outer conductor is provided to have a corrugated tube shape having corrugation crests and corrugation troughs formed therein, and wherein an outer diameter "I" of the insulator, an inner diameter $D_1$ of the corrugation crest formed in the outer conductor, and an inner diameter $D_2$ of the corrugation trough formed in the outer conductor have the following relationship:

$$\frac{D_1 + D_2}{2} \geq I \geq D_2,$$

and an air layer is formed between the insulator and the corrugation crest of the outer conductor, and a straight line section is provided in the corrugation crest of the outer conductor.

19 Claims, 4 Drawing Sheets

COAXIAL CABLE

CROSS REFERENCE TO PRIOR APPLICATION

The present application claims priority under 35 U.S.C. 119 and 35 U.S.C. 365 to Korean Patent Application No. 10-2009-0015331 (filed on Feb. 24, 2009), which is hereby incorporated by reference in its entirety.

TECHNICAL FIELD

The present invention relates to a coaxial cable, more particularly to a coaxial cable which includes an air layer between an insulator and a corrugation crest of an outer conductor thereof, and which includes a straight line section formed in the corrugation crest of the outer conductor, thereby reducing a relative dielectric constant of the whole cable, increasing a propagation velocity of a signal, and making the cutting of the cable easy.

BACKGROUND ART

Recently, a communication environment like a base station, etc., of a wireless communication environment employs a system which uses an element like a superconducting filter and the like. In order to transmit an ultrahigh frequency signal having more than hundreds of Megahertz in an ultrahigh frequency circuit in such a system, a coaxial cable having low signal attenuation is widely used.

That is, since the coaxial cable has not only a stable impedance and low attenuation characteristic, but also a high frequency characteristic such as an excellent shielding effect with respect to noise and the like, the coaxial cable is suitable for a high frequency communication line that is used in a base station required for a communication through a mobile phone transmitting a high frequency signal in a microwave band.

First, a structure of the coaxial cable will be described. The coaxial cable includes an inner conductor having a thin and long metallic wire shape located at the inside of the center thereof, an insulator made of an insulating material for surrounding the outside of the inner conductor, an outer conductor having a hollow cylindrical shape made of a metallic material for surrounding the outside of the insulator and a sheath made of the insulating material for surrounding the outer conductor.

When a coaxial cable is erected or assembled, or when the coaxial cable is connected to a terminal device, etc., located at a predetermined position, it is necessary to perform a bending process on such a coaxial cable. In this case, since a metal tube like a copper pipe is used as the outer conductor, the bending process cannot be easily performed. Furthermore, it is required to employ a device for exclusive use, for example, a tool for exclusive use and so on for the bending process.

Accordingly, FIG. 1 shows a coaxial cable having the outer conductor 125 with a corrugated tube shape having corrugation crests and corrugation troughs formed thereon in order to cause the bending process to be easily performed.

$$\text{signal propagation velocity} \propto \frac{1}{\sqrt{\text{relative dielectric constant}}} \quad (1)$$

Meanwhile, a signal propagation velocity of the coaxial cable and a relative dielectric constant of the cable have a relationship described in the expression (1) above.

Here, the relative dielectric constant of the cable is minimized so as to increase the signal propagation velocity. Here, however, there is a limit to minimize the relative dielectric constant to more than a certain level only through a method of changing a ratio of composition of an insulator.

Additionally, as described above, in the coaxial cable with the outer conductor having corrugation crests and corrugation troughs, which have a square wave shape, if the insulator inside the outer conductor has an uneven shape, the relative dielectric constant of the cable becomes different in accordance with the sections of the coaxial cable. Therefore, a constant propagation velocity of a signal cannot be provided according to the change of the relative dielectric constant in the longitudinal direction of the coaxial cable.

Besides, in the coaxial cable with the outer conductor having corrugation crests and corrugation troughs, which have a square wave shape, as described above, a curved surface of the outer conductor causes the cable to be cut obliquely right and left instead of perpendicularly to the longitudinal direction of the cable. Moreover, an edge for cutting the cable slides on the curved surface of the outer conductor.

DISCLOSURE

Technical Problem

Accordingly, the purpose of the present invention is to solve above-described problems, and is to provide a coaxial cable which includes an air layer between an insulator and a corrugation crest of an outer conductor thereof, reducing a relative dielectric constant of the whole cable, and increasing a propagation velocity of a signal.

Another purpose of the present invention is to provide a coaxial cable which includes a straight line section formed in a corrugation crest of an outer conductor, forming an air layer having a fixed size between the outer conductor and the corrugation crest, and maintaining a constant relative dielectric constant according to sections consisting of both the corrugation crests and the corrugation troughs in the longitudinal direction of the cable.

Another purpose of the present invention is to provide a coaxial cable which includes a straight line section formed in a corrugation crest of an outer conductor of the coaxial cable, making the cutting of the cable easy.

Technical Solution

To achieve said object, a coaxial cable according to the present invention includes: an inner conductor located at the center portion of the cable; an insulator surrounding the outside of the inner conductor; an outer conductor surrounding the outside of the insulator; and a sheath surrounding the outer conductor, wherein the outer conductor is provided to have a corrugated tube shape having corrugation crests and corrugation troughs formed therein, and wherein an outer diameter "I" of the insulator, an inner diameter $D_1$ of the corrugation crest formed in the outer conductor, and an inner diameter $D_2$ of the corrugation trough formed in the outer conductor have the following relationship:

$$\frac{D_1 + D_2}{2} \geq I \geq D_2,$$

and an air layer can be formed between the insulator and the corrugation crest of the outer conductor.

Here, a highest point of the corrugation crest formed in the outer conductor is expanded in the longitudinal direction of the cable, forming a straight line section in the corrugation crest on a cross-section of the longitudinal direction of the cable.

With respect to a corrugation pitch "P" of the outer conductor, a value of "x", which is a ratio of the outer conductor above a median line between a maximum height of the corrugation crest and a minimum height of the corrugation trough of the outer conductor, can have a range from 0.5 to 0.8.

The insulator can be formed by gas generation including 50 to 90 weight percent of high density polyethylene (HDPE), 10 to 50 weight percent of low density polyethylene (LDPE), and 0.1 to 3 weight percent of nucleating agent.

The inner conductor can be formed to be a hollow tube shape.

Materials of the inner conductor and the outer conductor can be copper.

To achieve said object, a coaxial cable according to the present invention includes: an inner conductor located at the center portion of the cable; an insulator surrounding the outside of the inner conductor; an outer conductor surrounding the outside of the insulator; and a sheath surrounding the outer conductor, wherein the outer conductor is provided to have a corrugated tube shape having corrugation crests and corrugation troughs formed therein, and wherein an outer diameter "I" of the insulator, an inner diameter $D_1$ of the corrugation crest formed in the outer conductor, and an inner diameter $D_2$ of the corrugation trough formed in the outer conductor have the following relationship:

$$\frac{D_1 + D_2}{2} \geq I \geq D_2,$$

wherein an outer diameter "d" of the inner conductor is formed to have a range from 4.42 mm to 5.22 mm, and an outer diameter "I" of the insulator is formed to have a range from 11 mm to 13 mm, and an inner diameter $D_1$ of the corrugation crest is formed to have a range from 12.82 mm to 13.82 mm, and an inner diameter $D_2$ of the corrugation trough is formed to have a range from 10.82 mm to 11.82 mm, and an air layer is formed between the insulator and the corrugation crest of the outer conductor.

Here, a highest point of the corrugation crest formed in the outer conductor is expanded in the longitudinal direction of the cable, forming a straight line section in the corrugation crest on a cross-section of the longitudinal direction of the cable.

A corrugation pitch "P" of the outer conductor can be formed to have a range from 4 mm to 6 mm, and a thickness "t" of the outer conductor can be formed to have a range from 0.15 mm to 0.26 mm.

With respect to a corrugation pitch "P" of the outer conductor, a value of "x", which is a ratio of the outer conductor above a median line between a maximum height of the corrugation crest and a minimum height of the corrugation trough of the outer conductor, can have a range from 0.5 to 0.8.

The insulator can be formed by gas generation including 50 to 90 weight percent of high density polyethylene (HDPE), 10 to 50 weight percent of low density polyethylene (LDPE), and 0.1 to 3 weight percent of nucleating agent.

The inner conductor can be formed to be a hollow tube shape, and materials of the inner conductor and the outer conductor can be copper.

To achieve said object, a coaxial cable according to the present invention includes: an inner conductor located at the center portion of the cable; an insulator surrounding the outside of the inner conductor; an outer conductor surrounding the outside of the insulator; and a sheath surrounding the outer conductor, wherein the outer conductor is provided to have a corrugated tube shape having corrugation crests and corrugation troughs formed therein, and wherein an outer diameter "I" of the insulator, an inner diameter $D_1$ of the corrugation crest formed in the outer conductor, and an inner diameter $D_2$ of the corrugation trough formed in the outer conductor have the following relationship:

$$\frac{D_1 + D_2}{2} \geq I \geq D_2,$$

wherein an outer diameter "d" of the inner conductor is formed to have a range from 8.6 mm to 9.4 mm, and an outer diameter "I" of the insulator is formed to have a range from 21.1 mm to 23.1 mm, and an inner diameter $D_1$ of the corrugation crest is formed to have a range from 23.92 mm to 24.92 mm, and an inner diameter $D_2$ of the corrugation trough is formed to have a range from 20.92 mm to 21.92 mm, and an air layer is formed between the insulator and the corrugation crest of the outer conductor.

Here, a highest point of the corrugation crest formed in the outer conductor is expanded in the longitudinal direction of the cable, forming a straight line section in the corrugation crest on a cross-section of the longitudinal direction of the cable.

A corrugation pitch "P" of the outer conductor can be formed to have a range from 6.4 mm to 7.4 mm, and a thickness "t" of the outer conductor can be formed to have a range from 0.15 mm to 0.26 mm.

With respect to a corrugation pitch "P" of the outer conductor, a value of "x", which is a ratio of the outer conductor above a median line between a maximum height of the corrugation crest and a minimum height of the corrugation trough of the outer conductor, can have a range from 0.5 to 0.8.

The insulator can be formed by gas generation including 50 to 90 weight percent of high density polyethylene (HDPE), 10 to 50 weight percent of low density polyethylene (LDPE), and 0.1 to 3 weight percent of nucleating agent.

The inner conductor can be formed to be a hollow tube shape, and materials of the inner conductor and the outer conductor can be copper.

To achieve said object, a coaxial cable according to the present invention includes: an inner conductor located at the center portion of the cable; an insulator surrounding the outside of the inner conductor; an outer conductor surrounding the outside of the insulator; and a sheath surrounding the outer conductor, wherein the outer conductor is provided to have a corrugated tube shape having corrugation crests and corrugation troughs formed therein, and wherein an outer diameter "I" of the insulator, an inner diameter $D_1$ of the corrugation crest formed in the outer conductor, and an inner diameter $D_2$ of the corrugation trough formed in the outer conductor have the following relationship:

$$\frac{D_1 + D_2}{2} \geq I \geq D_2,$$

wherein an outer diameter "d" of the inner conductor is formed to have a range from 12.7 mm to 13.5 mm, and an outer diameter "I" of the insulator is formed to have a range from 31.5 mm to 33.5 mm, and an inner diameter $D_1$ of the corrugation crest is formed to have a range from 34.8 mm to 35.8 mm, and an inner diameter $D_2$ of the corrugation trough is formed to have a range from 31.3 mm to 32.3 mm, and an air layer is formed between the insulator and the corrugation crest of the outer conductor.

Preferably, a highest point of the corrugation crest formed in the outer conductor is expanded in the longitudinal direction of the cable, forming a straight line section in the corrugation crest on a cross-section of the longitudinal direction of the cable.

A corrugation pitch "P" of the outer conductor can be formed to have a range from 7.5 mm to 8.5 mm, and a thickness "t" of the outer conductor can be formed to have a range from 0.25 mm to 0.36 mm.

With respect to a corrugation pitch "P" of the outer conductor, a value of "x", which is a ratio of the outer conductor above a median line between a maximum height of the corrugation crest and a minimum height of the corrugation trough of the outer conductor, can have a range from 0.5 to 0.8.

The insulator can be formed by gas generation including 50 to 90 weight percent of high density polyethylene (HDPE), 10 to 50 weight percent of low density polyethylene (LDPE), and 0.1 to 3 weight percent of nucleating agent.

The inner conductor can be formed to be a hollow tube shape, and materials of the inner conductor and the outer conductor can be copper.

Advantageous Effects

A coaxial cable according to the present invention includes an air layer between an insulator and a corrugation crest of an outer conductor thereof, reducing a relative dielectric constant of the whole cable, and increasing a propagation velocity of a signal.

Also, the coaxial cable according to the present invention includes a straight line section formed in a corrugation crest of an outer conductor, forming an air layer having a fixed size between the outer conductor and the corrugation crest, and maintaining a constant relative dielectric constant according to sections consisting of the corrugation crests and the corrugation troughs in the longitudinal direction of the cable.

Also, the coaxial cable according to the present invention includes the straight line section formed in a corrugation crest of an outer conductor thereof, making the cutting of the cable easy.

DESCRIPTION OF DRAWINGS

The drawings attached illustrate the preferable embodiment of the present invention, only helps further understanding of the idea of the present invention along with the detailed description of the present invention described in the below, and thus the present invention is not limitedly interpreted to the matters shown in the drawings.

MODE FOR INVENTION

Hereinafter, the present invention is described in detail with reference to the attached drawings.

Before the detailed description, it should be noted that the terms used in the present specification and the claims are not to be limited to their lexical meanings, but are to be interpreted to conform with the technical idea of the present invention under the principle that the inventor can properly define the terms for the best description of the invention made by the inventor.

Therefore, the embodiments and the constitution illustrated in the attached drawings are merely preferable embodiments according to the present invention, and thus they do not express all of the technical idea of the present invention, so that it should be understood that various equivalents and modifications can exist which can replace the embodiments described in the time of the application.

Figure 1:
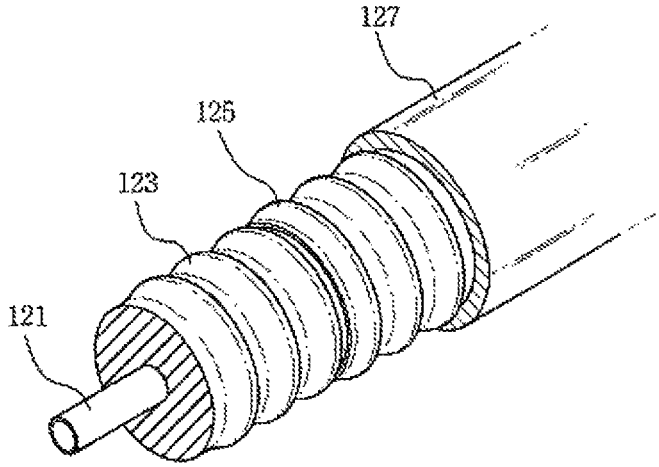
FIG. 1 Prior Art
FIG. 1 is a perspective view showing a conventional coaxial cable.
Figure 2:
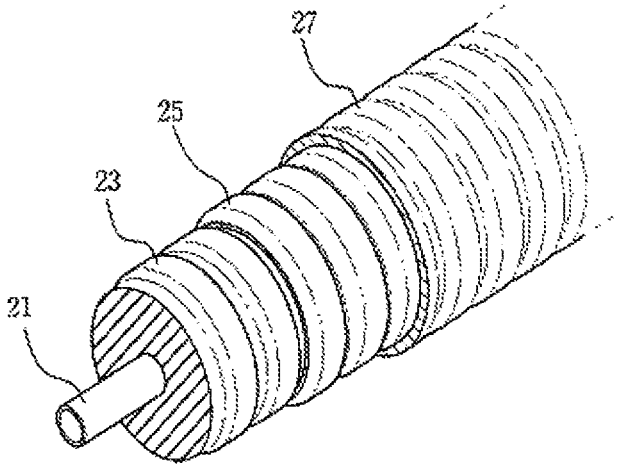
FIG. 2 is a perspective view showing a coaxial cable according to the present invention.
Figure 3:
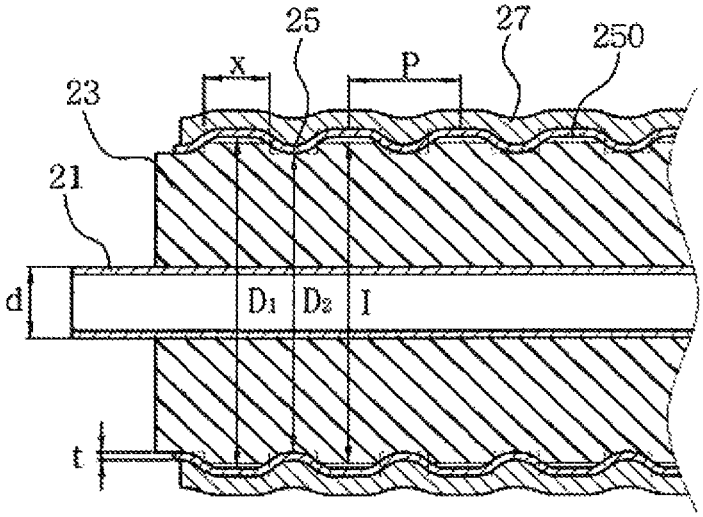
FIG. 3 is a longitudinal cross-sectional view of a coaxial cable according to the present invention.

FIG. 2 is a perspective view showing a coaxial cable according to the present invention. FIG. 3 is a longitudinal cross-sectional view of a coaxial cable according to the present invention.

In FIGS. 2 and 3, the coaxial cable according to the present invention is coated with an inner conductor 21 located at the center portion of the cable, an insulator 23 surrounding the outside of the inner conductor 21, an outer conductor 25 surrounding the outside of the insulator 23 and a sheath 27. The outer conductor 25 has a corrugated tube shape having corrugation crests and corrugation troughs which are arranged at a certain interval.

The inner conductor 21 transmits a cable signal and is located at the center portion of the cable. The inner conductor 21 is made of metallic material for easily transmitting a radio frequency signal.

Here, the inner conductor 21 may have various sizes of outer diameters "d". When the inner conductor 21 has a large cross-section for the purpose of minimizing the resistance for the signal just like an RF cable which is used in a communication base station, etc., for transmitting a radio frequency signal, the inner conductor 21 may have a hollow tube shape having a hollow formed in the center portion thereof so as to reduce the manufacturing cost as well as to increase the flexibility of the cable.

The inner conductor 21 may be formed of various metallic materials such as copper or aluminum and the like. The inner conductor 21 may be formed of copper or alloy including copper which has high conductivity and corrosion-resistance. The outer conductor 25 prevents the signal, which flows through the inner conductor 21, from leaking to the outside, and shields an external interference such as an external electromagnetic wave. The outer conductor 25 is manufactured with a metallic conductor having an excellent shielding function.

The outer conductor 25 may be formed of various metallic materials such as copper or aluminum and the like. The outer conductor 25 may be formed of copper or alloy including copper which has high conductivity and corrosion-resistance.

The outer conductor 25 is formed to have a cylindrical shaped tube that is spaced by a regular gap from the inner conductor 21. In FIGS. 2 and 3, the cable according to the present invention has a corrugated tube shape including a certain corrugated tube pitch "P" and thickness "t" in order to acquire flexibility.

The insulator 23 is formed of polymer insulating materials and is located between the inner conductor 21 and the outer conductor 25. The insulator 23 not only insulates the inner conductor 21 from the outer conductor 25 but evens the gap between the inner conductor 21 and the outer conductor 25.

Here, the insulator 23 may be formed of polymer foaming agents that form a plurality of porous cells such that a dielectric constant can be reduced for the purpose of increasing a propagation velocity of a signal being transmitted.

More specifically, the insulator 23 may be formed by gas generation caused by mixing nucleating agents with both high density polyethylene (HDPE) and low density polyethylene (LDPE). It is preferable to use carbon dioxide that is gas for easily forming foams having an excellent solubility and a high degree of foaming.

When only the HDPE is used for forming the insulator 23, the insulator 23 has excellent transmission characteristics, for example, low signal loss. However, it is not preferable because there is a limit to increase a degree of foaming. When only the LDPE is used for forming the insulator 23, it is possible to easily to increase the degree of foaming. However, it is not preferable because bad transmission characteristics are produced. Accordingly, when the insulator 23 is formed by mixing the HDPE with the LDPE in an appropriate ratio, it is possible to obtain both the high degree of foaming and excellent transmission characteristics.

Meanwhile, with regard to a polymer formed by mixing the foamed HDPE and the LDPE, since the nucleating agent enhances a crystallization rate of the polymer and causes the sizes of the crystals of the polymer to be fine, the nucleating agent is an additive for improving mechanical properties of the polymer.

That is, because the nucleating agent is able to change the crystallization rate and the sizes of the crystals of a polymer, the addition ratio of the polymer affects the size of a foam cell formed by crystallizing the polymer.

The nucleating agent is classified into an inorganic additive and an organic additive. The inorganic additive includes Talc, Silica and Kaolin, etc. The organic additive includes Mono or Polymer carboxylic acid.

Here, in the coaxial cable according to the present invention, since the insulator 23 is formed by carbon dioxide generation including 50 to 90 weight percent of the HDPE, 10 to 50 weight percent of the LDPE, and 0.1 to 3 weight percent of the nucleating agent, the degree of foaming of the insulator 23 is set to be over 75%, more preferably over 80%.

In FIG. 3, an outer diameter "I" of the insulator 23 signifies the maximum outer diameter of the insulator. It is clear that the outer diameter "I" of the insulator 23 is smaller than the inner diameter $D_1$ of the corrugation crest formed in the outer conductor 25 and is larger than the inner diameter $D_2$ of the corrugation trough formed in the outer conductor 25. Preferably, the outer diameter "I", the inner diameter $D_1$ and the inner diameter $D_2$ are formed such that they have the following relationship:

$$\frac{D_1 + D_2}{2} \geq I \geq D_2 \quad (2)$$

As a result, an air layer 250 can be formed between the insulator 23 and the corrugation crest of the outer conductor 25.

Since the outer diameter "I" of the insulator 23 is formed to be smaller than an intermediate value between the inner diameter $D_1$ of the corrugation crest of the outer conductor 25 and the inner diameter $D_2$ of the corrugation trough of the outer conductor 25, an air layer having a low relative dielectric constant occupies a certain space of the insulator 23, reducing the relative dielectric constant of a whole cable.

Further, since the outer diameter "I" of the insulator 23 is formed to be larger than the inner diameter $D_2$ of the corrugation trough of the outer conductor 25, the insulator 23 can be prevented from being separated from the outer conductor 25. That is, the insulator 23 can be prevented from being separated from a fixed position inside of the cable.

In other words, because the outer diameter "I" of the insulator 23, the inner diameter $D_1$ of the corrugation crest of the outer conductor 25, and the inner diameter $D_2$ of the corrugation trough of the outer conductor 25 have the relationship mentioned in the expression (2), the air layer 250 having sufficient size can be provided between the insulator 23 and the corrugation crest of the outer conductor 25.

Hereby, the whole cable which separates the inner conductor from the outer conductor by means of both the insulator 23 and the air layer 250 can have a relative dielectric constant smaller than that of a conventional cable which separates the inner conductor from the outer conductor by means of only the insulator 23.

In addition, since the air layer 250 allows the relative dielectric constant of the coaxial cable according to the present invention to be smaller than that of the conventional cable, it is possible to improve the propagation velocity of a cable signal based on the mentioned expression (1) compared with the propagation velocity of the conventional cable signal.

Figure 4:
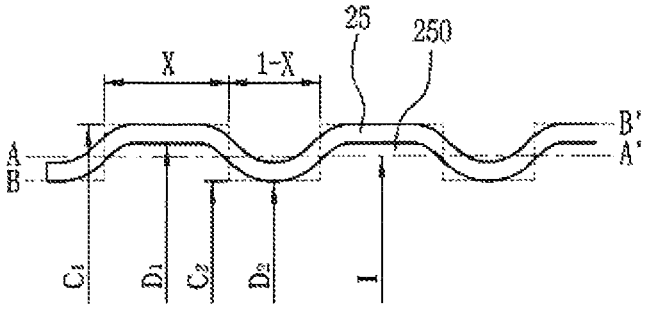
FIG. 4 is a cross-sectional view showing a partially enlarged outer conductor of the coaxial cable according to the present invention.
Figure 5:
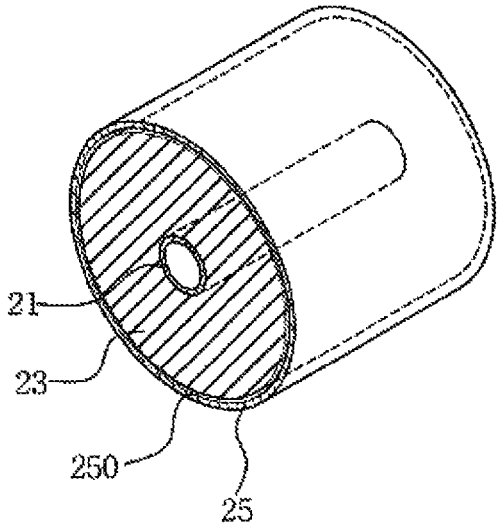
FIG. 5 is a perspective view showing shapes of an outer conductor, an air layer and an insulator in a straight line section formed in a corrugation crest of the outer conductor.

FIG. 4 is a cross-sectional view showing a partially enlarged outer conductor 25 of the coaxial cable according to the present invention. FIG. 5 is a perspective view showing shapes of an outer conductor 25, an air layer 250, and an insulator 23 in a straight line section formed in a corrugation crest of the outer conductor 25.

In FIGS. 3 and 4, the outer conductor 25 may include a uniform pitch "P" and may have a corrugated tube shape in which a corrugation crest and a corrugation trough are repeatedly and alternately formed.

That is, with respect to a straight line A-A' along the longitudinal direction of the cable based on an intermediate value between the maximum height of the corrugation crest and the minimum height of the corrugation trough, a section of the outer conductor 25, which is formed above the line A-A', is identified as a section in which the corrugation crest is formed. A section of the outer conductor 25, which is formed below the line A-A', is identified as a section in which the corrugation trough is formed.

In this case, the straight line A-A' along the longitudinal direction corresponds to a standard of the maximum size of the outer diameter "I" of the insulator 23.

The maximum inner diameter of the outer conductor 25 in the section in which the corrugation crest is formed is defined as an inner diameter $D_1$ between the corrugation crests. The minimum inner diameter of the outer conductor 25 in the section in which the corrugation trough is formed is defined as an inner diameter $D_2$ between the corrugation troughs.

The corrugation crests and the corrugation trough are repeatedly and alternately formed within a range from the maximum height $C_1$ of a virtual square wave B-B' to the minimum height $C_2$ of the virtual square wave B-B' in the outer conductor 25. Within one period of the square wave B-B', a section in which the corrugation crest is formed and a section in which the corrugation trough is formed can be represented by a numerical ratio.

Here, on the assuming that one period of the square wave B-B' is 1, if a section in which the corrugation crest is formed in the outer conductor 25 has a value of "x", a section in which the corrugation crest is formed has a value of 1-x.

Preferably, the value of "x" can be designed to have a value from 0.5 to 0.8. If the "x" is smaller than 0.5, it is difficult to obtain an air layer having sufficient size and difficult to cut the cable. If the "x" is greater than 0.8, bend property of the cable is deteriorated. As a result, a corrugated section of the outer conductor 25 is damaged or the corrugated section shape is difficult to maintain at the time of bending the cable.

Comprehensively considering manufacturing easiness, a relative dielectric constant, bend property and the like, when the value of "x" has a range from 0.6 to 0.75 in accordance with the outer diameter of the cable, a performance of the whole cable can be optimized.

Additionally, a highest point of the corrugation crest formed in the outer conductor 25 is expanded in the longitudinal direction of the cable, forming a straight line section in the corrugation crest on the cross-section of the longitudinal direction of the cable.

That is, a corrugated section of a conventional coaxial cable has a square wave shape. Therefore, a slope at each point on the cross-section of the corrugation crest changes continuously.

On the other hand, in the coaxial cable according to the present invention, a highest point of the corrugation crest of the outer conductor is expanded in the longitudinal direction of the cable by as much as a certain length in proportion to the value of x.

As a result, in the straight line section in the corrugation crest of the outer conductor 25, a cross-section of the cable, which is formed to have the outside of the outer conductor 25 as a contour, is maintained to have a fixed size toward a further longitudinal direction of the cable. Therefore, the coaxial cable according to the present invention can provide two advantageous effects.

One effect is that it is possible to obtain a section which allows the relative dielectric constant of the coaxial cable to be uniformly maintained due to both the insulator 23 and the air layer 250 having a cylindrical shape with the constant cross-section.

In a conventional coaxial cable having a corrugated section formed in the outer conductor thereof, an inner insulator has corrugations formed therein in accordance with the shape of the corrugated section in the outer conductor. Therefore, differences are caused among the insulator diameters depending on the sections along the longitudinal direction of the insulator, changing the consequent relative dielectric constant.

Particularly, when the corrugated section of the outer conductor does not have a regular shape or the corrugated section of the outer conductor is injured or squeezed by an external impact and the like, the insulator has also an irregular shape. As a result, the change amount of the relative dielectric constant is increased.

On the contrary, in the insulator 23 of the coaxial cable according to the present invention, the size of the maximum outer diameter "I" of the insulator 23 is set to a value which is equal to or less than the average value of the inner diameter of the corrugation crest and the inner diameter of the corrugation trough as described in the above-mentioned expression (2) instead of the inner diameter $D_1$ of the corrugation crest of the outer conductor 25. Therefore, a shape change of the insulator according to a shape change of the corrugated section is decreased, reducing a change amount of the relative dielectric constant.

The other effect is that the cable is easily cut due to the above-mentioned straight line section formed in the corrugation crest of the outer conductor 25.

Figure 6:
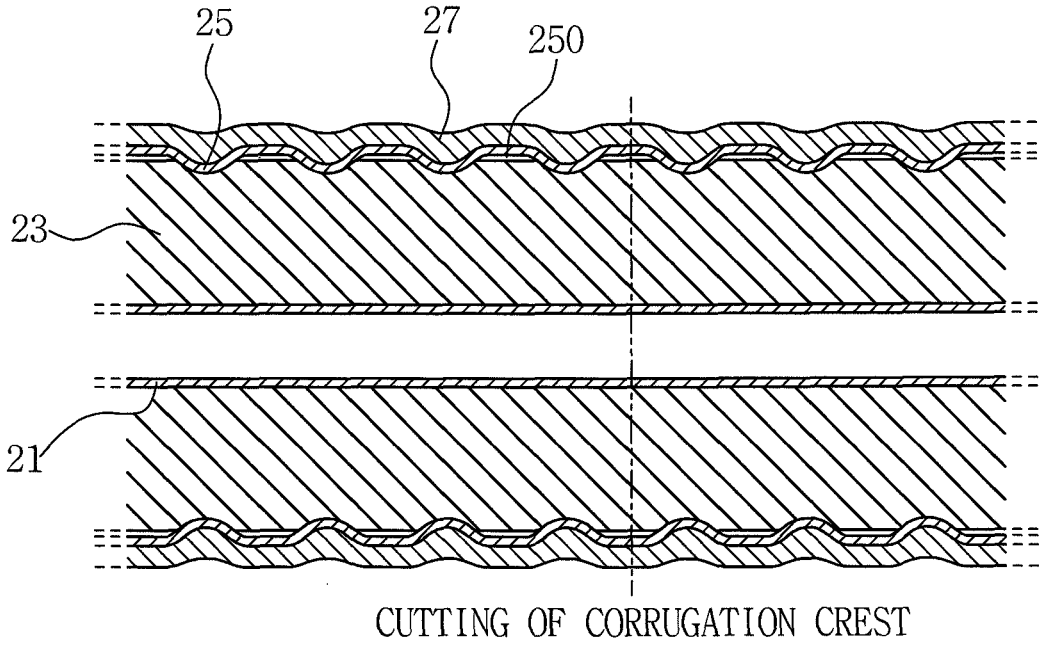
FIGS. 6 to 8 are schematic views showing how to connect other equipments with a coaxial cable according to the present invention.
Figure 7:
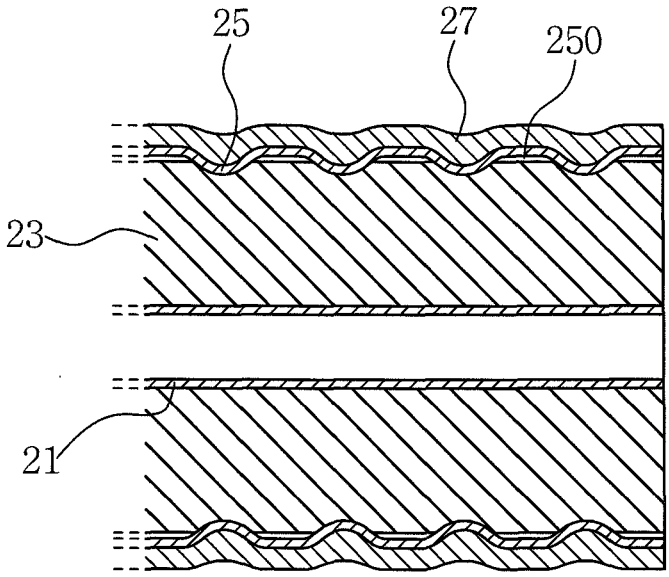
Figure 8:
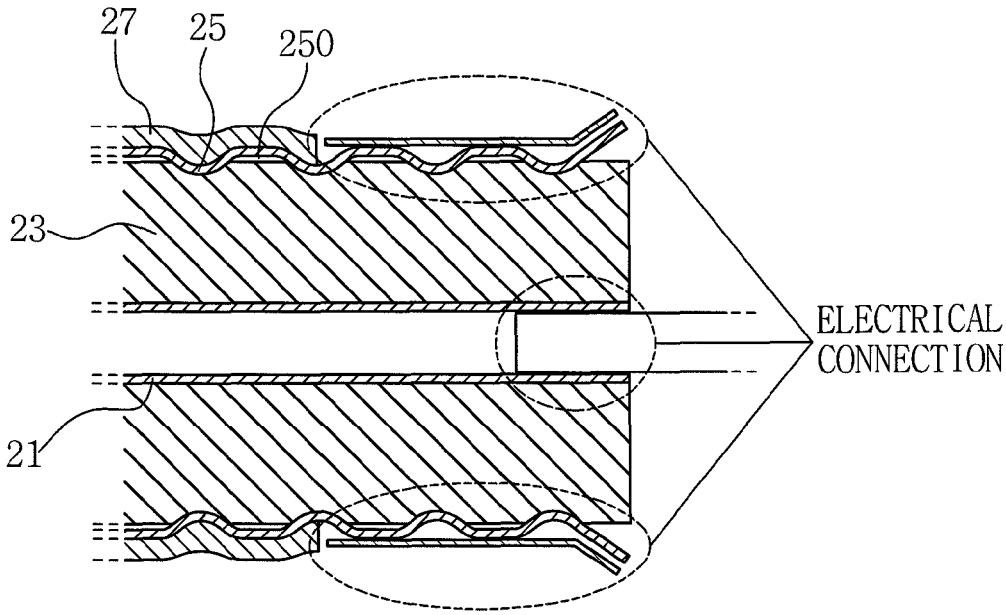

FIGS. 6 to 8 are schematic views showing how to connect other equipments with a coaxial cable according to the present invention. In FIGS. 6 to 8, a straight line section sufficiently formed in the cable can be easily cut by a cutter, etc.

On the other hand, in a conventional coaxial cable having a corrugated section formed in the outer conductor thereof, the corrugated section has a square wave shape, changing continuously a slope at each point on the cross-section of the corrugation crest. As a result, in cutting the conventional coaxial cable by means of a cutter and the like, the edge of a cutter slides on the slope of the corrugation crest, so that the corrugation trough may be cut. Also, the cable may be cut obliquely instead of perpendicularly with respect to the longitudinal direction of the cable.

Meanwhile, FIGS. 6 to 8 show that the coaxial cable according to the present invention is connected with other equipments. Here, since the value of "x" is provided larger than 0.5, the corrugation crest has a larger ratio than that of the corrugation trough. Accordingly, since it is easier to outward expand the outer conductor 25 with respect to the central axis of the cable after cutting the cable, the cable is allowed to be electrically and easily connected to other equipments.

Hereinafter, in accordance with an exemplary embodiment of the present invention, the following description relates to a coaxial cable having an outer diameter "d" of an inner conductor 21, an inner diameter $D_1$ between the corrugation crests of the outer conductor 25, an inner diameter $D_2$ between the corrugation troughs of the outer conductor 25, a thickness "t" of the outer conductor 25, and a pitch "P" of the outer conductor 25.

First Embodiment

When the outer diameter "d" of the inner conductor 21 of the coaxial cable according to the present invention has a range from 4.42 mm to 5.22 mm, the outer diameter "I" of the insulator 23 is formed to have a range from 11 mm to 13 mm so as to obtain a relative dielectric constant required by the coaxial cable.

According to the above-mentioned expression (2), the inner diameter $D_1$ of the corrugation crest of the outer conductor 25 is formed to have a range from 12.82 mm to 13.82 mm and the inner diameter $D_2$ is formed to have a range from 10.82 mm to 11.82 mm. Consequently, an air layer is formed between the insulator 23 and the corrugation crest of the outer conductor 25.

Here, when the inner diameter $D_1$ of the corrugation crest and the inner diameter $D_2$ of the corrugation trough are provided as described above, a corrugation pitch "P" of the outer conductor 25 is formed to have a range from 4 mm to 6 mm in order to appropriately bend the cable and to easily manufacture the cable. In this case, a thickness "t" of the outer conductor 25 is formed to have a range from 0.15 mm to 0.26 mm so as to easily manufacture the corrugation pitch.

The inner conductor 21 and the outer conductor 25 are formed of copper.

Further, in order to easily cut the cable and to acquire an air layer having sufficient size, a ratio "x" of the corrugation crest of the outer conductor 25 has a value from 0.5 to 0.8 within the pitch "P" and more preferably from 0.6 to 0.75. When the "x" has a value of 0.7 and the pitch "P" has a length of 5 mm, substantially, a corrugation crest per one period of the corrugated section of the outer conductor 25 is formed to have a length of 3.5 mm, and a corrugation trough per one period of the corrugated section of the outer conductor 25 is formed to have a length of 1.5 mm.

In the cable according to the present invention, the numerical values obtained above allow the relative dielectric constant to be uniformly maintained in accordance with the sections of the cable compared with a conventional cable. In addition, since the cable according to the present invention has a smaller relative dielectric constant, a propagation velocity of a signal can be increased.

In other words, if a conventional cable has elements having the same numerical values as those of the mentioned sections, and if the outer diameter of an insulator of the conventional cable has a range from 12.82 mm to 13.82 mm that is the same as the inner diameter of the corrugation crest, there exists no air layer between the outer conductor and the insulator. In this case, a relative dielectric constant of the conventional cable is measured as 1.36.

Additionally, the propagation velocity of a signal in the cable is measured as 85.7% as much as that of a signal in air in accordance with the relative dielectric constant of 1.36.

On the other hand, in the coaxial cable according to the first embodiment of the present invention, a relative dielectric constant of the cable is measured as 1.29, and therefore, the propagation velocity of a signal in the cable is measured as 88% as much as that of a signal in air.

Consequently, it can be understood that the propagation velocity of a signal in the cable according to the first embodiment of the present invention is increased by over 2% compared with that of the conventional coaxial cable.

In the meantime, since a straight line section is formed in the corrugation crest of the outer conductor 25 according to the first embodiment of the present invention on the cross-section of the longitudinal direction of the coaxial cable, the cable can be more easily cut than the conventional coaxial cable.

Second Embodiment

When the outer diameter "d" of the inner conductor 21 of the coaxial cable according to the present invention has a range from 8.6 mm to 9.4 mm, the outer diameter "I" of the insulator 23 is formed to have a range from 21.1 mm to 23.1 mm so as to obtain a relative dielectric constant required by the coaxial cable.

According to the above-mentioned expression (2), the inner diameter $D_1$ of the corrugation crest of the outer conductor 25 is formed to have a range from 23.92 mm to 24.92 mm and the inner diameter $D_2$ is formed to have a range from 20.92 mm to 21.92 mm. Consequently, an air layer is formed between the insulator 23 and the corrugation crest of the outer conductor 25.

Here, when the inner diameter $D_1$ of the corrugation crest and the inner diameter $D_2$ of the corrugation trough are provided as described above, a corrugation pitch "P" of the outer conductor 25 is formed to have a range from 6.4 mm to 7.4 mm in order to appropriately bend the cable and to easily manufacture the cable. In this case, a thickness "t" of the outer conductor 25 is formed to have a range from 0.15 mm to 0.26 mm so as to easily manufacture the corrugation pitch.

The inner conductor 21 and the outer conductor 25 are formed of copper. Particularly, the inner conductor 21 is formed to have a hollow tube shape, increasing bend property of the cable and reducing the manufacturing cost of the cable.

Further, in order to easily cut the cable and to acquire an air layer having sufficient size, a ratio "x" of the corrugation crest of the outer conductor 25 has a value from 0.5 to 0.8 within the pitch "P" and more preferably from 0.6 to 0.75. When the "x" has a value of 0.7 and the pitch "P" has a length of 7 mm, substantially, a corrugation crest per one period of the corrugated section of the outer conductor 25 is formed to have a length of 4.9 mm, and a corrugation trough per one period of the corrugated section of the outer conductor 25 is formed to have a length of 2.1 mm.

In the cable according to the present invention, the numerical values obtained above allow the relative dielectric constant to be uniformly maintained in accordance with the sections of the cable compared with a conventional cable. In addition, since the cable according to the present invention has a smaller relative dielectric constant, a propagation velocity of a signal can be increased.

In other words, if a conventional cable has elements having the same numerical values as those of the mentioned sections, and if the outer diameter of an insulator of the conventional cable has a range from 23.92 mm to 24.92 mm that is the same as the inner diameter of the corrugation crest, there exists no air layer between the outer conductor and the insulator. In this case, a relative dielectric constant of the conventional cable is measured as 1.35.

Additionally, the propagation velocity of a signal in the cable is measured as 86.1% as much as that of a signal in air in accordance with the relative dielectric constant of 1.35.

On the other hand, in the coaxial cable according to the second embodiment of the present invention, a relative dielectric constant of the cable is measured as 1.28, and therefore, the propagation velocity of a signal in the cable is measured as 88.4% as much as that of a signal in air. Consequently, it can be understood that the propagation velocity of a signal in the cable according to the first embodiment of the present invention is increased by over 2% compared with that of the conventional coaxial cable.

In the meantime, since a straight line section is formed in the corrugation crest of the outer conductor 25 according to the second embodiment of the present invention on the cross-section of the longitudinal direction of the coaxial cable, the cable can be more easily cut than the conventional coaxial cable.

Third Embodiment

When the outer diameter "d" of the inner conductor 21 of the coaxial cable according to the present invention has a range from 12.7 mm to 13.5 mm, the outer diameter "I" of the insulator 23 is formed to have a range from 31.5 mm to 33.5 mm so as to obtain a relative dielectric constant required by the coaxial cable.

According to the above-mentioned expression (2), the inner diameter $D_1$ of the corrugation crest of the outer conductor 25 is formed to have a range from 34.8 mm to 35.8 mm and the inner diameter $D_2$ is formed to have a range from 31.3 mm to 32.3 mm Consequently, an air layer is formed between the insulator 23 and the corrugation crest of the outer conductor 25.

Here, when the inner diameter $D_1$ of the corrugation crest and the inner diameter $D_2$ of the corrugation trough are provided as described above, a corrugation pitch "P" of the outer conductor 25 is formed to have a range from 7.5 mm to 8.5 mm in order to appropriately bend the cable and to easily manufacture the cable. In this case, a thickness "t" of the outer conductor 25 is formed to have a range from 0.25 mm to 0.36 mm so as to easily manufacture the corrugation pitch.

The inner conductor 21 and the outer conductor 25 are formed of copper. Particularly, the inner conductor 21 is formed to have a hollow tube shape, increasing bend property of the cable and reducing the manufacturing cost of the cable.

Further, in order to easily cut the cable and to acquire an air layer having sufficient size, a ratio "x" of the corrugation crest of the outer conductor 25 has a value from 0.5 to 0.8 within the pitch "P" and more preferably from 0.6 to 0.75. When the "x" has a value of 0.7 and the pitch "P" has a length of 8 mm, substantially, a corrugation crest per one period of the corrugated section of the outer conductor 25 is formed to have a length of 5.6 mm, and a corrugation trough per one period of the corrugated section of the outer conductor 25 is formed to have a length of 2.4 mm.

In the cable according to the present invention, the numerical values obtained above allow the relative dielectric constant to be uniformly maintained in accordance with the sections of the cable compared with a conventional cable. In addition, since the cable according to the present invention has a smaller relative dielectric constant, a propagation velocity of a signal can be increased.

In other words, if a conventional cable has elements having the same numerical values as those of the mentioned sections, and if the outer diameter of an insulator of the conventional cable has a range from 34.8 mm to 35.8 mm that is the same as the inner diameter of the corrugation crest, there exists no air layer between the outer conductor and the insulator. In this case, a relative dielectric constant of the conventional cable is measured as 1.34.

Additionally, the propagation velocity of a signal in the cable is measured as 86.4% as much as that of a signal in air in accordance with the relative dielectric constant of 1.34. On the other hand, in the coaxial cable according to the third embodiment of the present invention, a relative dielectric constant of the cable is measured as 1.27, and therefore, the propagation velocity of a signal in the cable is measured as 88.7% as much as that of a signal in air.

Consequently, it can be understood that the propagation velocity of a signal in the cable according to the first embodiment of the present invention is increased by over 2% compared with that of the conventional coaxial cable.

In the meantime, since a straight line section is formed in the corrugation crest of the outer conductor 25 according to the third embodiment of the present invention on the cross-section of the longitudinal direction of the coaxial cable, the cable can be more easily cut than the conventional coaxial cable.

Although the present invention has been described with reference to the specified examples in the above, but the idea of the present invention is not limited to the above described matters and various changes and modifications can be made within the equivalent scope of the present invention and the following claims by the ordinary-skilled person of the art.

The invention claimed is:

1. A coaxial cable comprising:

an inner conductor located at a center portion of the cable;

an insulator surrounding a surface of the inner conductor;

an outer conductor surrounding an outside surface of the insulator; and a sheath surrounding the outer conductor, wherein the outer conductor has a corrugated tube shape having corrugation crests and corrugation troughs formed therein, and wherein an outer diameter I of the insulator, an inner diameter $D_1$ of the corrugation crest formed in the outer conductor, and an inner diameter $D_2$ of the corrugation trough formed in the outer conductor have the following relationship:

$$\frac{D_1 + D_2}{2} \geq I \geq D_2,$$

wherein a space between the inner conductor and an inner surface of the outer conductor is filled up with the insulator so that an air layer isolated within a corrugated portion of the outer conductor is formed between the insulator and the corrugation crest of the outer conductor, wherein a highest point of the corrugation crest formed in the outer conductor is expanded in the longitudinal direction of the cable, forming a straight line section in the corrugation crest on a cross-section of the longitudinal direction of the cable, wherein the outer diameter I of the insulator is larger than the inner diameter $D_2$ of the corrugation trough, wherein the straight line section in the corrugation crest and the outermost surface of the insulator which contacts with the air layer are substantially parallel to each other so that the air layer has a uniform thickness, wherein an above-to-below ratio of the lengths of the outer conductor above and below a median line between a maximum height of the corrugation crest and a minimum height of the corrugation trough of the outer conductor, has a range from 0.5 to 0.8.

2. The coaxial cable according to claim 1, wherein the insulator is formed by gas generation including 50 to 90 weight percent of high density polyethylene, 10 to 50 weight percent of low density polyethylene, and 0.1 to 3 weight percent of nucleating agent.

3. The coaxial cable according to claim 1, wherein the inner conductor is formed to be a hollow tube shape.

4. The coaxial cable according to claim 1, wherein materials of the inner conductor and the outer conductor are copper.

5. A coaxial cable comprising:

an inner conductor located at a center portion of the cable;

an insulator surrounding a surface of the inner conductor;

an outer conductor surrounding an outside surface of the insulator; and a sheath surrounding the outer conductor, wherein the outer conductor has a corrugated tube shape having corrugation crests and corrugation troughs formed therein, and wherein an outer diameter I of the insulator, an inner diameter $D_1$ of the corrugation crest formed in the outer conductor, and an inner diameter $D_2$ of the corrugation trough formed in the outer conductor have the following relationship:

$$\frac{D_1 + D_2}{2} \geq I \geq D_2,$$

wherein an outer diameter d of the inner conductor is formed to have a range from 4.42 mm to 5.22 mm, and an outer diameter I of the insulator is formed to have a range from 11 mm to 13 mm, and an inner diameter $D_1$ of the corrugation crest is formed to have a range from 12.82 mm to 13.82 mm, and an inner diameter $D_2$ of the corrugation trough is formed to have a range from 10.82 mm to 11.82 mm, wherein a space between the inner conductor and an inner surface of the outer conductor is filled up with the insulator so that an air layer isolated within a corrugated portion of the outer conductor is formed between the insulator and the corrugation crest of the outer conductor, wherein a highest point of the corrugation crest formed in the outer conductor is expanded in the longitudinal direction of the cable, forming a straight line section in the corrugation crest on a cross-section of the longitudinal direction of the cable, wherein the outer diameter I of the insulator is larger than the inner diameter $D_2$ of the corrugation trough, wherein the straight line section in the corrugation crest and the outermost surface of the insulator which contacts with the air layer are substantially parallel to each other so that the air layer has a uniform thickness.

6. The coaxial cable according to claim 5, wherein a corrugation pitch "P" of the outer conductor is formed to have a range from 4 mm to 6 mm, and a thickness "t" of the outer conductor is formed to have a range from 0.15 mm to 0.26 mm.

7. The coaxial cable according to claim 5, wherein an above-to-below ratio of the lengths of the outer conductor above and below a median line between a maximum height of the corrugation crest and a minimum height of the corrugation trough of the outer conductor, has a range from 0.5 to 0.8.

8. The coaxial cable according to claim 5, wherein the insulator is formed by gas generation including 50 to 90 weight percent of high density polyethylene, 10 to 50 weight percent of low density polyethylene, and 0.1 to 3 weight percent of nucleating agent.

9. The coaxial cable according to claim 5, wherein the inner conductor is formed to be a hollow tube shape, and materials of the inner conductor and the outer conductor are copper.

10. A coaxial cable comprising:

an inner conductor located at a center portion of the cable;

an insulator surrounding a surface of the inner conductor;

an outer conductor surrounding an outside surface of the insulator; and a sheath surrounding the outer conductor, wherein the outer conductor has a corrugated tube shape having corrugation crests and corrugation troughs formed therein, and wherein an outer diameter I of the insulator, an inner diameter $D_1$ of the corrugation crest formed in the outer conductor, and an inner diameter $D_2$ of the corrugation trough formed in the outer conductor have the following relationship:

$$\frac{D_1 + D_2}{2} \geq I \geq D_2,$$

wherein an outer diameter d of the inner conductor is formed to have a range from 8.6 mm to 9.4 mm, and an outer diameter I of the insulator is formed to have a range from 21.1 mm to 23.1 mm, and an inner diameter $D_1$ of the corrugation crest is formed to have a range from 23.92 mm to 24.92 mm, and an inner diameter $D_2$ of the corrugation trough is formed to have a range from 20.92 mm to 21.92 mm, wherein a space between the inner conductor and an inner surface of the outer conductor is filled up with the insulator so that an air layer isolated within a corrugated portion of the outer conductor is formed between the insulator and the corrugation crest of the outer conductor, wherein a highest point of the corrugation crest formed in the outer conductor is expanded in the longitudinal direction of the cable, forming a straight line section in the corrugation crest on a cross-section of the longitudinal direction of the cable, wherein the outer diameter I of the insulator is larger than the inner diameter $D_2$ of the corrugation trough, wherein the straight line section in the corrugation crest and the outermost surface of the insulator which contacts with the air layer are substantially parallel to each other so that the air layer has a uniform thickness.

11. The coaxial cable according to claim 10, wherein a corrugation pitch "P" of the outer conductor is formed to have a range from 6.4 mm to 7.4 mm, and a thickness "t" of the outer conductor is formed to have a range from 0.15 mm to 0.26 mm.

12. The coaxial cable according to claim 10, wherein an above-to-below ratio of the lengths of the outer conductor above and below a median line between a maximum height of the corrugation crest and a minimum height of the corrugation trough of the outer conductor, has a range from 0.5 to 0.8.

13. The coaxial cable according to claim 10, wherein the insulator is formed by gas generation including 50 to 90 weight percent of high density polyethylene, 10 to 50 weight percent of low density polyethylene, and 0.1 to 3 weight percent of nucleating agent.

14. The coaxial cable according to claim 10, wherein the inner conductor is formed to be a hollow tube shape, and materials of the inner conductor and the outer conductor are formed of copper.

15. A coaxial cable comprising:

an inner conductor located at a center portion of the cable;

an insulator surrounding a surface of the inner conductor;

an outer conductor surrounding an outside surface of the insulator; and a sheath surrounding the outer conductor, wherein the outer conductor has a corrugated tube shape having corrugation crests and corrugation troughs formed therein, and wherein an outer diameter I of the insulator, an inner diameter $D_1$ of the corrugation crest formed in the outer conductor, and an inner diameter $D_2$ of the corrugation trough formed in the outer conductor have the following relationship:

$$\frac{D_1 + D_2}{2} \geq I \geq D_2,$$

wherein an outer diameter d of the inner conductor is formed to have a range from 12.7 mm to 13.5 mm, and an outer diameter I of the insulator is formed to have a range from 31.5 mm to 33.5 mm, and an inner diameter D1 of the corrugation crest is formed to have a range from 34.8 mm to 35.8 mm, and an inner diameter D2 of the corrugation trough is formed to have a range from 31.3 mm to 32.3 mm, wherein a space between the inner conductor and an inner surface of the outer conductor is filled up with the insulator so that an air layer isolated within a corrugated portion of the outer conductor is formed between the insulator and the corrugation crest of the outer conductor, wherein a highest point of the corrugation crest formed in the outer conductor is expanded in the longitudinal direction of the cable, forming a straight line section in the corrugation crest on a cross-section of the longitudinal direction of the cable, wherein the outer diameter I of the insulator is larger than the inner diameter $D_2$ of the corrugation trough, wherein the straight line section in the corrugation crest and the outermost surface of the insulator which contacts with the air layer are substantially parallel to each other so that the air layer has a uniform thickness.

16. The coaxial cable according to claim 15, wherein a corrugation pitch "P" of the outer conductor is formed to have a range from 7.5 mm to 8.5 mm, and a thickness "t" of the outer conductor is formed to have a range from 0.25 mm to 0.36 mm.

17. The coaxial cable according to claim 15, wherein an above-to-below ratio of the lengths of the outer conductor above and below a median line between a maximum height of the corrugation crest and a minimum height of the corrugation trough of the outer conductor, has a range from 0.5 to 0.8.

18. The coaxial cable according to claim 15, wherein the insulator is formed by gas generation including 50 to 90 weight percent of high density polyethylene, 10 to 50 weight percent of low density polyethylene, and 0.1 to 3 weight percent of nucleating agent.

19. The coaxial cable according to claim 15, wherein the inner conductor is formed to be a hollow tube shape, and materials of the inner conductor and the outer conductor are copper.

* * * * *